US005377763A

United States Patent [19]

Pearce et al.

[11] Patent Number: 5,377,763

[45] Date of Patent: Jan. 3, 1995

[54] RISER PIPE ASSEMBLY FOR MARINE APPLICATIONS

[75] Inventors: Robert G. Pearce; Donald D. Baldwin, both of Lincoln, Nebr.

[73] Assignee: Brunswick Corporation, Lake Forest, Ill.

[21] Appl. No.: 199,960

[22] Filed: Feb. 22, 1994

[51] Int. Cl.[6] ..... E21B 17/01; E21B 19/02

[52] U.S. Cl. ..... 166/367; 166/380; 166/382; 166/385; 285/137.2; 285/25

[58] Field of Search ..... 166/367, 350, 359, 380, 166/382, 385, 384, 77.5, 97.5, 242, 65.1; 405/195.1; 285/137.2, 139, 140, 25

[56] References Cited

U.S. PATENT DOCUMENTS

| | | | |
|---|---|---|---|
| 3,768,842 | 10/1973 | Ahlstone | 285/55 |
| 4,078,605 | 3/1978 | Jones | 175/7 X |
| 4,142,584 | 3/1979 | Brewer et al. | 166/359 |
| 4,194,568 | 3/1980 | Burési et al. | 166/340 |
| 4,397,357 | 8/1983 | Hettinger | 166/345 |
| 4,411,434 | 10/1983 | Lewis | 277/27 |
| 4,437,688 | 3/1984 | Kramer et al. | 285/95 |
| 4,470,722 | 9/1984 | Gregory | 405/195 |
| 4,611,656 | 9/1986 | Kendall, Jr. et al. | 166/65.1 |
| 4,619,323 | 10/1986 | Gidley | 166/65.1 X |
| 4,634,314 | 1/1987 | Pierce | 405/195 |
| 4,681,169 | 7/1987 | Brookbank, III | 166/385 |
| 4,696,494 | 9/1987 | Schmitz et al. | 285/18 |
| 4,728,224 | 3/1988 | Salama et al. | 405/195 |
| 4,867,605 | 9/1989 | Myers et al. | 405/169 |

*Primary Examiner*—Stephen J. Novosad

*Attorney, Agent, or Firm*—Wood, Phillips, VanSanten, Hoffman & Ertel

[57] ABSTRACT

A riser pipe assembly is provided for interconnecting a subsea wellhead on an ocean floor with an above-surface platform. The assembly includes at least one cable extending generally between the wellhead and the platform to provide vertical support for the assembly. A plurality of support plates are fixed to the cable at predetermined spaced locations therealong. At least one riser pipe string extends between the wellhead and the platform and includes a plurality of riser pipes engaged end-to-end. In one embodiment of the invention, each riser pipe includes a lower bell-shaped end and an upper spigot-shaped end inserted into the bell-shaped end of the immediately adjacent riser pipe thereabove. The lower bell-shaped end of each riser pipe rests by gravity on and is supported by one of the support plates. In another embodiment of the invention, each riser pipe includes an upper bell-shaped end and a lower spigot-shaped end inserted into the bell-shaped end of the immediately adjacent riser pipe therebelow. The enlarged juncture of the upper bell-shaped end of each riser pipe rests by gravity on and is supported by one of the support plates.

28 Claims, 3 Drawing Sheets

RISER PIPE ASSEMBLY FOR MARINE APPLICATIONS

FIELD OF THE INVENTION

This invention generally relates to the art of riser pipe assemblies and, particularly, to such assemblies for interconnecting a subsea wellhead on an ocean floor with an above-surface platform.

BACKGROUND OF THE INVENTION

Floating or anchored production systems have been used to transfer fluids, such as crude oil and natural gas, between subsea installations and the water surface in offshore areas. Whereas, fixed platforms have been common for many years in such production systems, floating platforms have become attractive as petroleum production extends water depths beyond the economic and physical limitations of fixed platforms. Generally, fluid handling lines or conduits are used to transfer the hydrocarbons between the subsea wellheads on the ocean floor and the above-surface platforms. As is known in the art, these lines or conduits commonly are called "production riser pipe strings" which permit the movement of fluids from the wellhead to the platform and "drilling riser pipe strings" which permit drilling pipe strings to be lowered into and raised from the wellhead and provide a conduit through which drilling fluid may be returned to the above-surface installation during drilling operations. In essence, a riser pipe string simply is a plurality of tubular riser pipes connected end-to-end between the wellhead and the drilling installation.

As deeper and deeper hydrocarbon reservoirs are discovered, it seems that ever increasingly complex and sophisticated production systems have been developed, including the riser pipe strings, between the wellhead and the drilling installation. Most riser pipe strings include couplings which fairly rigidly interconnect the riser pipes in an end-to-end string. The couplings of opposing pipe ends interconnect, such as by threaded male and female coupling components. The couplings most often are fabricated at least in part of metal material. Such couplings are quite limiting in resiliency and are compliantly restrained in lateral directions, allowing only limited sway, surge and yaw, all of which is undesirable in subsea applications.

The present invention is directed to providing an extremely simple, yet efficient, riser pipe assembly or system which is very compliant in use and completely eliminates the need for tensile load carrying couplings or connections between the individual pipes of the riser pipe strings. With the present invention, each pipe is supported individually rather than supporting an entire pipe string or substantial portion thereof. In addition, the system of the invention invites the use of low cost, lightweight, corrosion resistant composite riser pipes which, heretofore, have not been popular in wellhead applications.

Heretofore, composite riser pipes have been considered undesirable because of their low value of axial modulus in comparison to higher values of metal riser pipes, such as of steel. The present invention overcomes this limitation by combining the desirable axial modulus of metal in a supporting cable and the desirable features of composite pipes as well.

Still further, prior art systems encounter the problem of individually tensioning each riser pipe in a cluster of riser pipe strings. The present invention solves this problem by avoiding the need for individual tensioning devices. The invention eliminates significant riser length change during use due to temperature, pressure and fluid density changes inside the riser pipes, and also permits a larger diameter, flexible riser.

SUMMARY OF THE INVENTION

An object, therefore, of the invention is to provide a new and improved riser pipe assembly for interconnecting a subsea wellhead on an ocean floor with an above-surface platform.

In the exemplary embodiment of the invention, the riser pipe assembly includes at least one cable extending generally between the well-head and the platform to provide vertical support for the assembly. A plurality of support plates are fixed to the cable at predetermined spaced locations therealong. At least one riser pipe string extends between the wellhead and the platform and includes a plurality of riser pipes engaged end-to-end. In one embodiment of the invention, each pipe includes a lower bell-shaped end and an upper spigot-shaped end inserted into the bell-shaped end of the immediately adjacent riser pipe thereabove. The lower bell-shaped end of each riser pipe rests by gravity on and is supported by one of the support plates. Therefore, each support plate must support only the individual riser pipe immediately thereabove in each riser pipe string.

As disclosed herein, the cable extends through an opening in each support plate. The plate is vertically located and supported on the cable by a stop member fixed to the cable. The stop member is disclosed as a stop sleeve clamped to the cable.

The support plates are structured such that only a portion of a peripheral edge of the bell-shaped end of each riser pipe rests on its respective support plate. The support plates are located transversely between the riser type string and the cable. Each support plate has an arcuate cut-out in a peripheral edge thereof at which the peripheral edge of the bell-shaped end of the respective riser pipe rests. The arcuate cut-out extends in an arc of less than 180° so that the riser pipe string can be assembled onto the plates laterally of the vertically supporting cable. Other features of the invention include the provision of seal means between the inside of the bell-shaped end and the outside of the spigot-shaped end of each pair of engaged pipes. This sealed interconnection provides for considerable lateral compliancy for the assembly. In addition, each support plate is part of a support plate assembly including at least two support plates having closed ended slots opening at respective edges of the plates. Therefore, the plates also can be assembled to the cable transversely thereof by relative insertion of the cable into the slots. The plates then can be relatively rotated to orient the slots in a manner to define a closed opening through the plates surrounding the cable.

Lastly, it is contemplated that a plurality of the riser pipe strings be angularly spaced about a single vertically supporting cable. Each support plate supports the lower bell-shaped end of a riser pipe in each of the plurality of strings. Cinch means are provided surrounding the riser pipe strings to hold the strings in a cluster about the cable.

In another embodiment of the invention, each riser pipe includes an upper bell-shaped end and a lower spigot-shaped end inserted into the bell-shaped end of the immediately adjacent riser pipe therebelow. The necked-down area at the bottom of the bell-shaped end of each riser pipe rests by gravity on and is supported by one of the support plates. Therefore, again, each support plate must support only the individual riser pipe in each riser pipe string. Generically, the invention contemplates that each pipe in the riser pipe string include a radially outwardly projecting portion for resting by gravity on and supported by one of the support plates.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
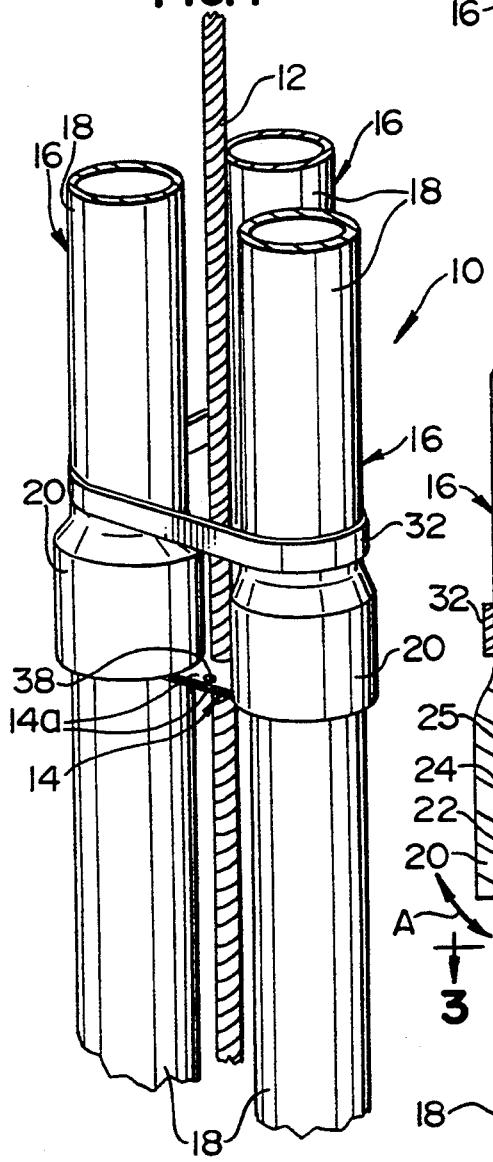
FIG. 1 is a fragmented perspective view of a riser pipe assembly embodying the concepts of the invention.

Referring to the drawings in greater detail, and first to FIG. 1, one embodiment of the invention is incorporated in a riser pipe assembly, generally designated 10, for interconnecting a subsea wellhead on an ocean floor with an above-surface platform. The assembly includes at least one cable 12 extending generally between the wellhead and the platform to provide vertical support for the assembly. A plurality of support plate assemblies, generally designated 14, are fixed to cable 12 at predetermined spaced locations therealong. Generally, the support plate assemblies support, by gravity, at least one riser pipe string, generally designated 16. The illustrated embodiment of the invention shows the plate assemblies supporting three riser pipe strings 16, although this number can vary from one to whatever number can be supported about the periphery of a given sized plate assembly.

Cable 12 often is called a "wire rope". In any event, this type of cable is quite common in subsea well applications to support various subsea equipment to the above-surface platforms. Generally, the cable often is a braided or twisted steel wire construction.

Figure 2:
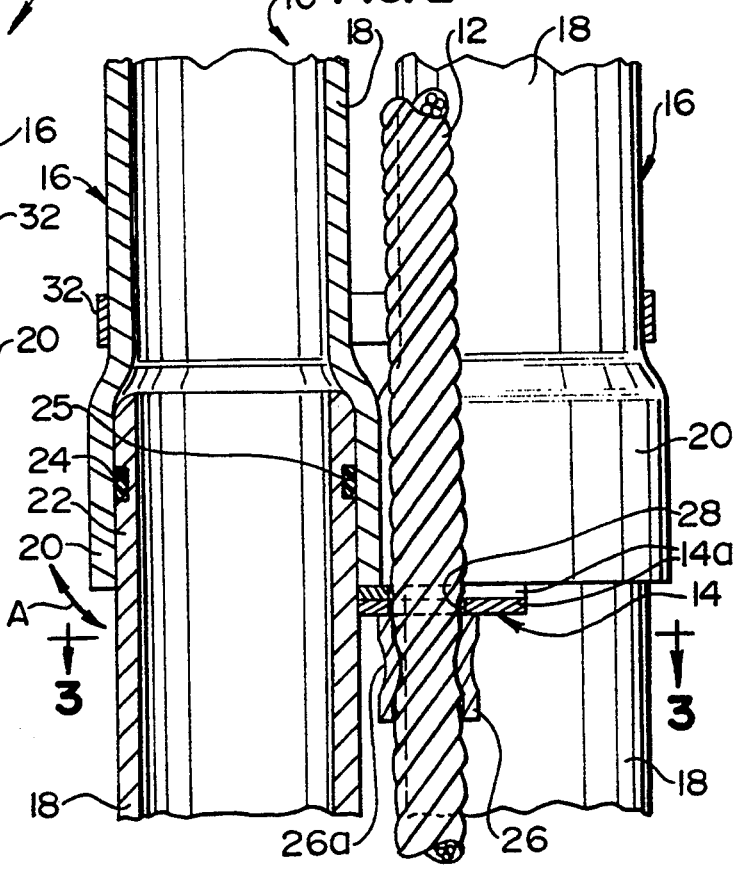
FIG. 2 is a side elevational view, with a section through one of the pipe strings, the plate assembly and the stop sleeve, as taken generally along line 2—2 of FIG. 3.

Referring to FIG. 2 in connection with FIG. 1, each riser pipe string 16 includes a plurality of riser pipes 18 engaged end-to-end. Each riser pipe includes a lower bell-shaped end 20 and an upper spigot-shaped end 22. The spigot-shaped end of each pipe is inserted into the bell-shaped end of the immediately adjacent riser pipe thereabove, as is clearly shown in FIG. 2. A seal, such as a flexible O-ring seal 24 is located between the inside of the bell-shaped end 20 and the outside of the spigot-shaped end 22 of each pair of engaged pipes. The seal may be engaged in a peripheral groove in one of the ends, such as groove 25 in spigot-shaped end 22. Preferably, the seal should be set in a groove in the outside surface of the spigot-shaped end of the pipe if the pipe is a filament wound structure, so that the seal will engage the smooth interior surface of the bell-shaped end, because the interior surface of the bell-shaped end is a tool surface due to the filament winding process.

It immediately can be seen in FIG. 2 that a degree of angularly compliancy, as represented by double-headed arrow "A", is afforded by the interengagement of the bell and spigot connections between adjacent pipes, versus the compliantly restricting connections of the couplings of the prior art, such as prior threaded male and female couplings. In addition, the pipes can be filament wound, and the hoop stiffness of the spigot-shaped ends can be designed to be less than the hoop stiffness of the bell-shaped ends so that the connection will tend to tighten, not loosen, during pressurization of the pipe strings.

FIG. 2 also shows that each support plate assembly 14 is vertically located and supported on cable 12 by a stop member 26 fixed to the cable. The stop member is shown as a stop sleeve which is clamped or crimped, as at **26*a*, onto the cable. Each support plate assembly 14 defines an opening 28 through which cable 12 freely extends. In other words, it can be seen that plate assembly 14 in FIG. 2 rests by gravity on top of stop sleeve 26, and the bell-shaped ends 20 of riser pipes 18, in turn, rest by gravity on the top of support plate assembly 14**. The extremely simple construction and function of this riser pipe system is readily apparent in comparison with the complicated systems of the prior art.

Figure 3:
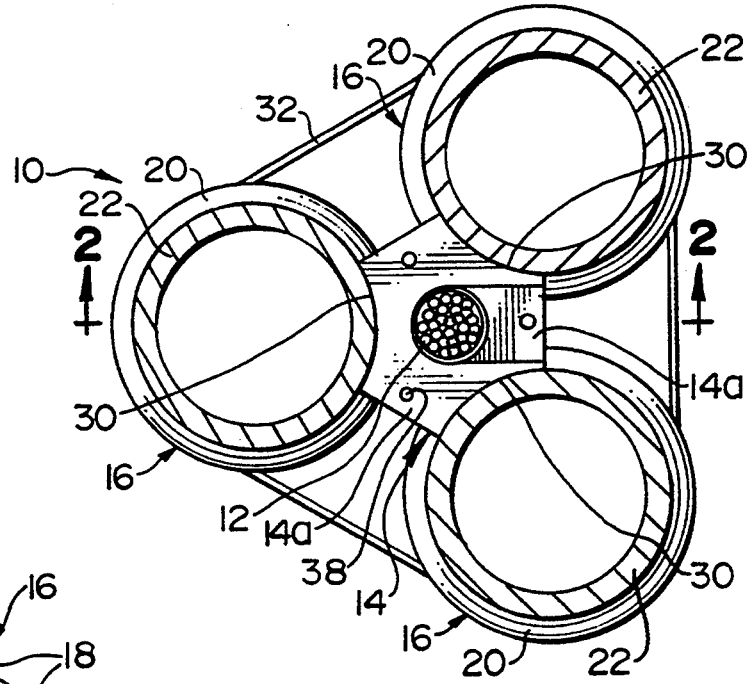
FIG. 3 is a horizontal section taken generally along line 3—3 of FIG. 2.

FIG. 3 best shows how the assembly or system of the invention allows riser pipe strings 16 to be assembled quite readily to cable 12 and support plate assemblies 14 laterally or transversely of the vertically extending cable. In other words, the pipe strings or the individual riser pipes thereof do not have to be assembled through holes in any supporting plate structures.

More particularly, referring to FIG. 3 in conjunction with FIGS. 1 and 2, each support plate assembly has an arcuate cut-out 30 which engages the riser pipes at their spigot-shaped ends 22 below the larger bell-shaped ends 20 of the immediately adjacent riser pipes thereabove. In essence, the support plate assemblies are structured such that only a portion of the peripheral edge of the bell-shaped end of each riser pipe rests on the support plate. This portion is defined by the length of a respective arcuate cut-out 30 of the support plate assembly. Of course, the cut-outs must extend in an arc of less than 180° (e.g. if there were only one or two pipe strings) so that the pipe strings can be assembled about cable 12 in a direction transversely thereof. Once assembled, with the bell-shaped ends of the riser pipes in each string thereof resting on top of support plate assembly 14, means such as a cinch strap 32 is used to surround the pipe strings and hold the strings in a cluster about cable 12 and supported by plate assembly 14. In essence, the cinch strap prevents the bell-shaped ends of the pipes from slipping off of the support plate assemblies. If it is desired to limit vertical movement of the pipes, the cinch strap could be additionally fixed below the stop sleeves 26.

Figure 4A:
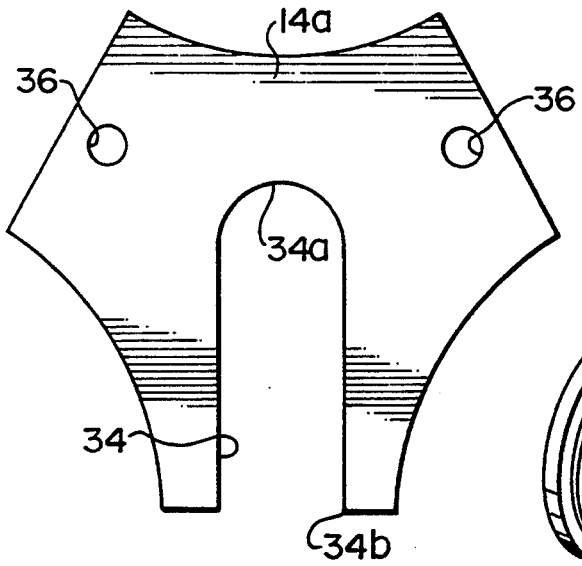
FIG. 4A is a plan view of one of the support plates.
Figure 4B:
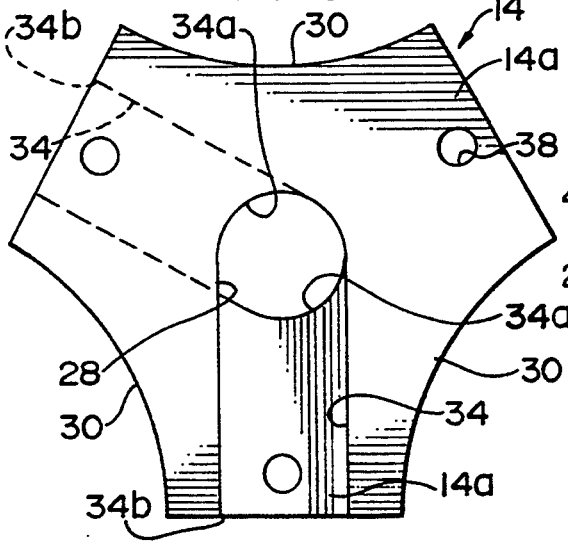
FIG. 4B is a pair of support plates oriented to define a closed opening therethrough.

FIG. 4A shows a single support plate 14*a*, and FIG. 4B shows support plate assembly 14 including a pair of support plates 14*a* in juxtaposition as shown in FIGS. 1–3. The support plate assembly is configured to allow assembly thereof in a direction laterally or transversely of cable 12.

More particularly, each support plate 14*a* includes a slot 34 having a closed end 34*a* generally centrally of the plate and an open end 34*b* at the edge of the plate. Therefore, each plate can be assembled onto cable 12 transversely thereof, by relatively inserting the cable into the open ended slot. By using two support plates 14a, the plates can be assembled to the cable, and then rotated relative to each other to close opening 28 through the support plate assembly 14, surrounding cable 12. Each support plate 14a has a plurality of holes 36 as referenced in FIG. 4A. When the plates are relatively rotated to the positions shown in FIG. 4B, two of the holes in the respective plates will be aligned, as at 38, and a pin (not shown) can be inserted therethrough to hold the plates in their relatively rotated positions to completely surround cable 12 and laterally fix support plate assembly 14 about the cable.

The terms "plate assembly" and "plate" have been used herein to describe and claim the thin, flat plate-like structures 14 and 14*a*, respectively. However, it should be understood that the invention is considered to encompass any structure which performs the supporting functions described herein of the components 14 and 14*a*, and the use of said terms are to be construed as so encompassing.

Figure 5:
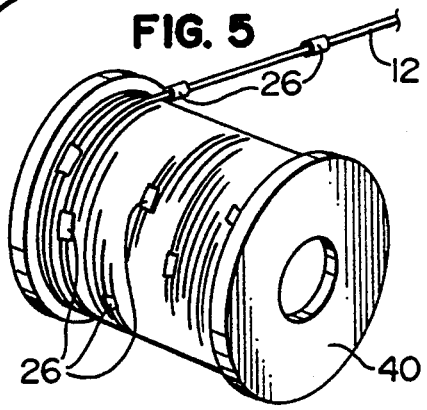
FIG. 5 is an illustration of the support cable, with attached stop sleeves, wound onto a spool.

FIG. 5 shows a unique advantage of the invention wherein cable 12 is wound onto a spool 40 and from which the cable can be fed from an above-surface platform downwardly to subsea wellhead applications. It can be seen that the relatively small stop sleeves 26 have been clamped or fixed to the cable at predetermined locations therealong. The distance between any two stop sleeves 26 is equal to the length between the seals of a given riser pipe 18 in riser pipe string 16. As described and illustrated above, support plate assemblies 14 and the riser pipe strings, themselves, can be assembled to cable 12 laterally or transversely of the cable.

Figure 6:
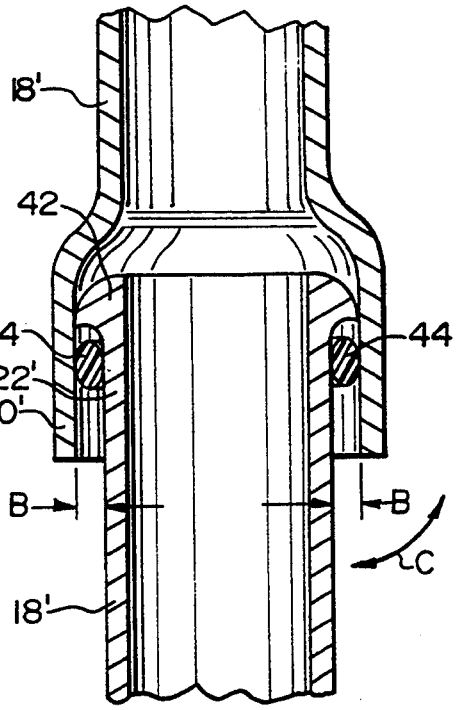
FIG. 6 is an axial section through the interconnected ends of an alternate embodiment of the invention.

FIG. 6 shows an alternate embodiment of the invention wherein each riser pipe 18' includes a lower bell-shaped end 20' which is larger in diameter than the bell-shaped ends 20 in FIGS. 1–3. Each riser pipe 18' includes a spigot-end having an enlarged, rounded flange 42 projecting radially outwardly from the spigot-shaped end 22' thereof. This embodiment provides a larger radial clearance, as indicated by double-headed arrows "B", between the bell-shaped end of one riser pipe and the spigot-shaped end of the other riser pipe. Such a construction allows for greater angular compliancy in the pipe string as indicated by double-headed arrow "C". Seals 44 are provided between the inside of the bell-shaped end 20' and the outside of the spigot-shaped end 22'.

Figure 7:
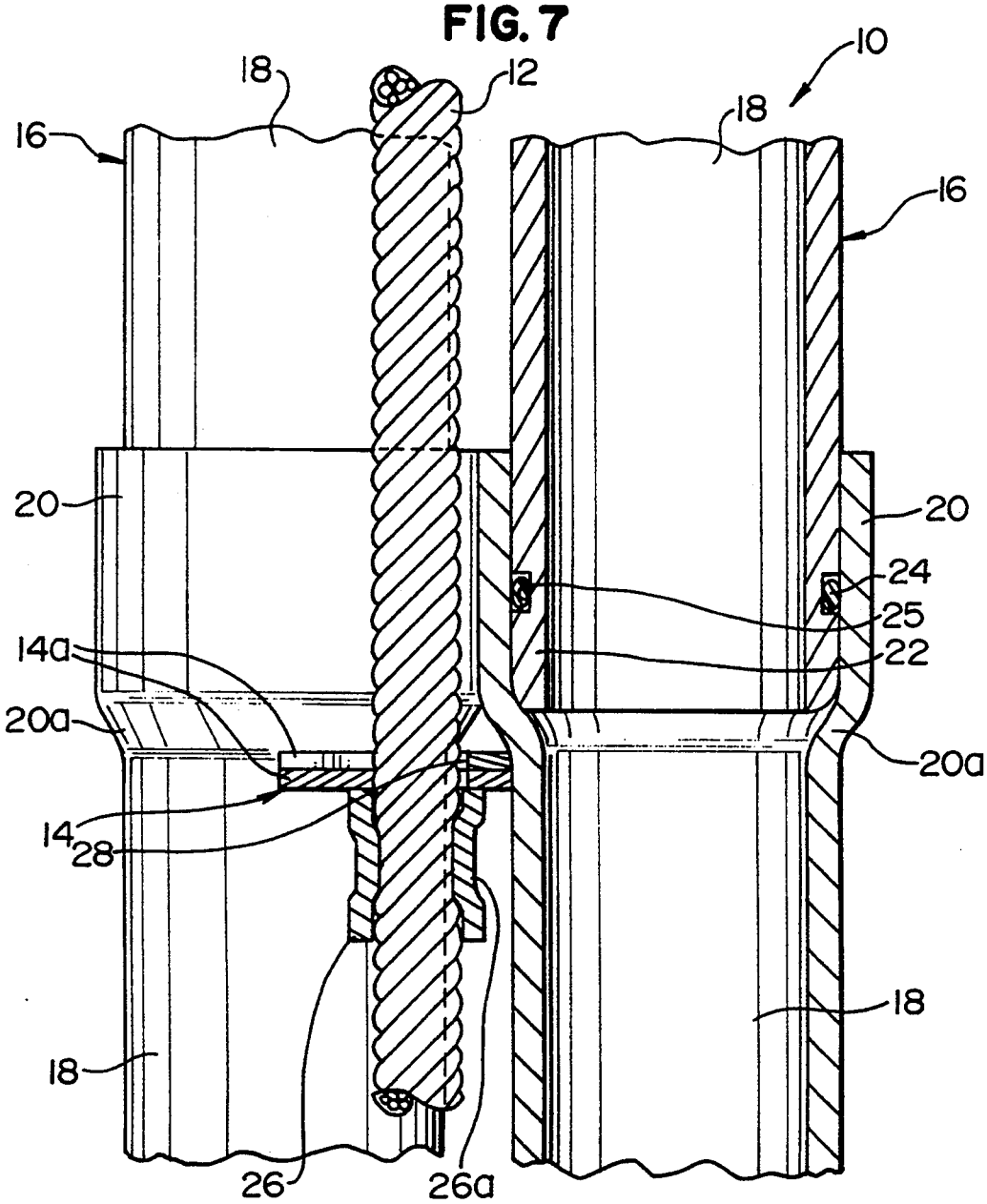
FIG. 7 is a view similar to that of FIG. 2, but of a further embodiment of the invention.

Lastly, FIG. 7 shows a further embodiment of the invention which can easily be compared to the previous embodiment by reference to FIG. 2. Basically, in the embodiment of FIG. 7, the riser pipes 18 in riser pipe strings 16 have been inverted, with no other structural changes. Therefore, like reference numerals have been applied in FIG. 7 corresponding to the embodiment of the invention shown and described above in relation to FIGS. 1–5.

In the embodiment of FIG. 7, it can be seen that each riser pipe 18 has an upper bell-shaped end 20 and a lower spigot-shaped end 22 inserted into the bell-shaped end of the immediately adjacent riser pipe therebelow. With the riser pipes inverted, the outside surface has an enlarged juncture 20*a* between the enlarged bell-shaped end 20 and the remaining length of the riser pipe. This enlarged juncture provides a means which can rest by gravity on and be supported by one of the plate assemblies 14. Otherwise, the embodiment of FIG. 7 functions the same as in comparison to the first embodiment represented by FIG. 2. Consequently, the invention generically contemplates that each riser pipe have a radially outwardly projecting means or portion for resting by gravity on and supported by a support means fixed to cable 12.

The advantages of the invention, as described above, are quite numerous. As stated above, most riser pipe strings used today employ couplings between the adjacent ends of the riser pipes. Such couplings or end fittings are completely eliminated by the invention. End fittings comprise an area of high development and high production costs in pipe string manufacturing. The invention avoids corrosion caused by electrochemical cells between the end fittings and the composite material of the riser pipes, since there are no end fittings.

The invention also eliminates the need for transmitting tensile or bending loads from one riser pipe to the next riser pipe, since the riser pipes rest on plate assemblies 14. In fact, any given plate assembly supports only the riser pipes immediately thereabove. Consequently, the supporting plate assemblies need only bear against the lower bell-shaped ends of the riser pipes and not against the full periphery of the bell-shaped ends. This is allowed because the contact stresses are low. For instance, a pipe section which is forty feet long, with an eight inch inside diameter and a ten inch outside diameter, made of E-glass/epoxy composite will weigh approximately 950 pounds in air and approximately 500 pounds in water. A contact surface of only five square inches, about 1/6 the end face area of the bell-shaped end, in this example, will cause an average contact stress or only 100 p.s.i.

In addition, dimensional tolerance requirements of the riser pipes are considerably less with the free interconnections between the pipes, and this reduces manufacturing costs of the pipes and the cable with attached stop sleeves. The flexible seals will accommodate length mismatches between the cable support spacing and the length of the pipe sections. The requirements for tight tolerances on the flatness and the perpendicularity of the bell-shaped ends to the pipe axis is completely eliminated.

The labor and equipment required for assembly and disassembly of the riser pipe assembly of the invention is considerably less than encountered with prior art coupling (e.g. threaded) connections that must be kept clean until assembly, coated with a threading compound, threaded together and then tightened with power equipment. Flanged couplings also must be brought together to align the bolt hole patterns and then assemble all of the bolts, again with power equipment. In contrast, the interengagement of the riser pipes in the system of the present invention need only be kept clean and inserted together with hand force. Bending stiffness and bending strength of the interengagements between the pipe sections can be varied by varying the radial clearance and the length of the engagement between the bell-shaped ends and the spigot-shaped ends of the riser pipes, as comparing the embodiments in FIGS. 2 and 6. Of course, the range ot angular compliancy also is thereby varied as described above.

A significant advantage of the present invention is that it shifts the tensile load carrying responsibility from the riser pipe end connections to the vertically supporting cable. This eliminates the need for significant axial tensile strength in the pipe end connections. Such a system makes it quite inviting to use low cost, light weight, corrosion resistant composite riser pipes instead of the all-steel pipe sections most common today or even instead of composite pipe sections with metal end fittings. In essence, the invention eliminates the need for the pipe sections, themselves, to transmit tensile or bending loads and the concomitant need for metal end fittings. Some composite materials, such as carbon fiber, cause corrosion to metal end fittings. Corrosion prevention and protection measures add cost to such composite riser pipe assemblies. The present invention eliminates the weight and cost of the metal end fittings, the need for corrosion prevention and protection measures for the interface between the composite and the metal end fittings, and the need for costly tensile and bending load carrying reinforcing fibers in the wall of the composite pipe. In essence, development risk and production costs of a successful composite riser pipe assembly has been shifted by the invention from the structural end fittings of the prior art to simple flexible seals. The cost of a suitable flexible seal is considerably less than a suitable end fitting, and the weight and production cost of the seals is significantly less than that of end fittings.

It will be understood that the invention may be embodied in other specific forms without departing from the spirit or central characteristics thereof. The present examples and embodiments, therefore, are to De considered in all respects as illustrative and not restrictive, and the invention is not to be limited to the details given herein.

We claim:

1. A riser pipe assembly for interconnecting a subsea wellhead on an ocean floor with an above-surface platform, comprising:

at least one cable extending generally between the wellhead and the platform to provide vertical support for the assembly;

a plurality of support plates fixed to the cable at predetermined spaced locations therealong; and at least one riser pipe string extending between the wellhead and the platform and including a plurality of riser pipes engaged end-to-end with each pipe including a lower bell-shaped end and an upper spigot-shaped end inserted into the bell-shaped end of the immediately adjacent riser pipe thereabove, the lower bell-shaped end of each riser pipe resting by gravity on and supported by one of said support plates.

2. The riser pipe assembly of claim 1 wherein said cable extends through an opening in each support plate, and the plate is vertically located and supported on the cable by a stop member fixed to the cable.

3. The riser pipe assembly of claim 2 wherein said stop member comprises a stop sleeve clamped to the cable.

4. The riser pipe assembly of claim 1 wherein each said support plate is part of a support plate assembly including at least two support plates having closed ended slots opening at respective edges of the plates, whereby the plates can be assembled to the cable transversely thereof by relatively inserting the cable into the slots, and the plates can be relatively rotated to orient the slots in a manner to define a closed opening through the plates surrounding the cable.

5. The riser pipe assembly of claim 1 wherein said support plates are structured such that only a portion of a peripheral edge of the bell-shaped end of each riser pipe rests on its support plate.

6. The riser pipe assembly of claim 5 wherein said support plates are located transversely between the riser pipe string and the cable, and each support plate has an arcuate cut-out in a peripheral edge thereof at which the peripheral edge of the bell-shaped end of the respective riser pipe rests.

7. The riser pipe assembly of claim 6 wherein said arcuate cutout extends in an arc of less than 180°.

8. The riser pipe assembly of claim 1, including a plurality of said riser pipe strings angularly spaced about said cable, with each support plate supporting the lower bell-shaped end of a riser pipe in each string.

9. The riser pipe assembly of claim 8, including cinch means surrounding the riser pipe strings to hold the strings in a cluster about the cable.

10. The riser pipe assembly of claim 1, including resilient seal means between the inside of the bell-shaped end and the outside of the spigot-shaped end of each pair of engaged pipes.

11. A riser pipe assembly for interconnecting a subsea wellhead on an ocean floor with an above-surface platform, comprising:

at least one cable extending generally between the wellhead and the platform to provide vertical support for the assembly;

a plurality of support plates fixed to the cable at predetermined spaced locations therealong; and a plurality of riser pipe strings angularly spaced about said cable and extending between the wellhead and the platform, each riser pipe string including a plurality of riser pipes engaged end-to-end with each pipe including a lower bell-shaped end and an upper spigot-shaped end inserted into the bell-shaped end of the immediately adjacent riser pipe thereabove, the lower bell-shaped end of each riser pipe resting by gravity on and supported by one of said support plates, each support plate being structured such that only a portion of a peripheral edge of the bell-shaped end of each riser pipe rests on its respective support plate.

12. The riser pipe assembly of claim 11 wherein said cable extends through an opening in each support plate, and the plate is vertically located and supported on the cable by a stop member fixed to the cable.

13. The riser pipe assembly of claim 12 wherein said stop member comprises a stop sleeve clamped to the cable.

14. The riser pipe assembly of claim 11 wherein each said support plate is part of a support plate assembly including at least two support plates having closed ended slots opening at respective edges of the plates, whereby the plates can be assembled to the cable transversely thereof by relatively inserting the cable into the slots, and the plates can be relatively rotated to orient the slots in a manner to define a closed opening through the plates surrounding the cable.

15. The riser pipe assembly of claim 11 wherein said support plates are located transversely between the riser pipe strings and the cable, and each support plate has an arcuate cut-out in a peripheral edge thereof at which the peripheral edge of the bell-shaped end of a respective one of the riser pipes rests.

16. The riser pipe assembly of claim 15 wherein said arcuate cutouts extend in an arc of less than 180°.

17. The riser pipe assembly of claim 11, including cinch means surrounding the riser pipe strings to hold the strings in a cluster about the cable.

18. The riser pipe assembly of claim 11, including resilient seal means between the inside of the bell-shaped end and the outside of the spigot-shaped end of each pair of engaged pipes.

19. A riser pipe assembly for interconnecting a subsea wellhead on an ocean floor with an above-surface platform, comprising:

at least one cable extending generally between the wellhead and the platform to provide vertical support for the assembly;

a plurality of support members fixed to the cable at predetermined spaced locations therealong; and at least one riser pipe string extending between the wellhead and the platform and including a plurality of riser pipes freely engaged end-to-end with each pipe including a radially outwardly projecting means for resting by gravity on and supported by one of said support members.

20. The riser pipe assembly of claim 19 wherein said cable extends through an opening in each support member, and the support member is vertically located and supported on the cable by a stop member fixed to the cable.

21. The riser pipe assembly of claim 20 wherein said stop member comprises a stop sleeve clamped to the cable.

22. The riser pipe assembly of claim 19 wherein the ends of adjacent riser pipes are telescopingly engaged and including resilient seal means between the telescoped ends of the pipes.

23. A riser pipe assembly for interconnecting a subsea wellhead on an ocean floor with an above-surface platform, comprising:

at least one cable extending generally between the wellhead and the platform to provide vertical support for the assembly;

a plurality of support members fixed to the cable at predetermined spaced locations therealong; and at least one riser pipe string extending between the wellhead and the platform and including a plurality of riser pipes engaged end-to-end with each pipe including an upper bell-shaped end and a lower spigot-shaped end inserted into the bell-shaped end of the immediately adjacent riser pipe therebelow, an enlarged juncture of the bell-shaped end of each riser pipe resting lay gravity on and supported by one of the support members.

24. The riser pipe assembly of claim 23 wherein said cable extends through an opening in each support member, and the support member is vertically located and supported on the cable by a stop member fixed to the cable.

25. The riser pipe assembly of claim 24 wherein said stop member comprises a stop sleeve clamped to the cable.

26. The riser pipe assembly of claim 23, including a plurality of said riser pipe strings angularly spaced about said cable, with each support member supporting the bell-shaped end of a riser pipe in each string.

27. The riser pipe assembly of claim 26, including cinch means surrounding the riser pipe strings to hold the strings in a cluster about the cable.

28. The riser pipe assembly of claim 23, including resilient seal means between the inside of the bell-shaped end and the outside of the spigot-shaped end of each pair of engaged pipes.

* * * * *